United States Patent [19]

Provencher

[11] 4,072,956

[45] Feb. 7, 1978

[54] MULTIFREQUENCY ARRAY USING COMMON PHASORS

[75] Inventor: Joseph H. Provencher, San Diego, Calif.

[73] Assignee: The United States of America as represented by the Secretary of the Navy, Washington, D.C.

[21] Appl. No.: 686,855

[22] Filed: May 17, 1976

[51] Int. Cl.[2] ..... H01Q 3/22

[52] U.S. Cl. ..... 343/844; 343/854

[58] Field of Search ..... 343/854, 778, 844, 853

[56] References Cited

U.S. PATENT DOCUMENTS 3,518,695 3/1977 Schroeder ..... 343/854

3,771,163 11/1973 Marinaccio ..... 343/854

*Primary Examiner*—Eli Lieberman

*Attorney, Agent, or Firm*—R. S. Sciascia; G. J. Rubens; H. Fendelman

[57] ABSTRACT

A single antenna array having a phase shifter at the input of each antenna element and fed by a multifrequency input for simultaneously generating at least two beams. When the different excitation frequencies are simultaneously inputted into the phase shifters, a separate phase increment is introduced into each radiator for each frequency. The result is a separate beam output from each frequency input, the beams being generated simultaneously but at different beam pointing angles.

10 Claims, 1 Drawing Figure

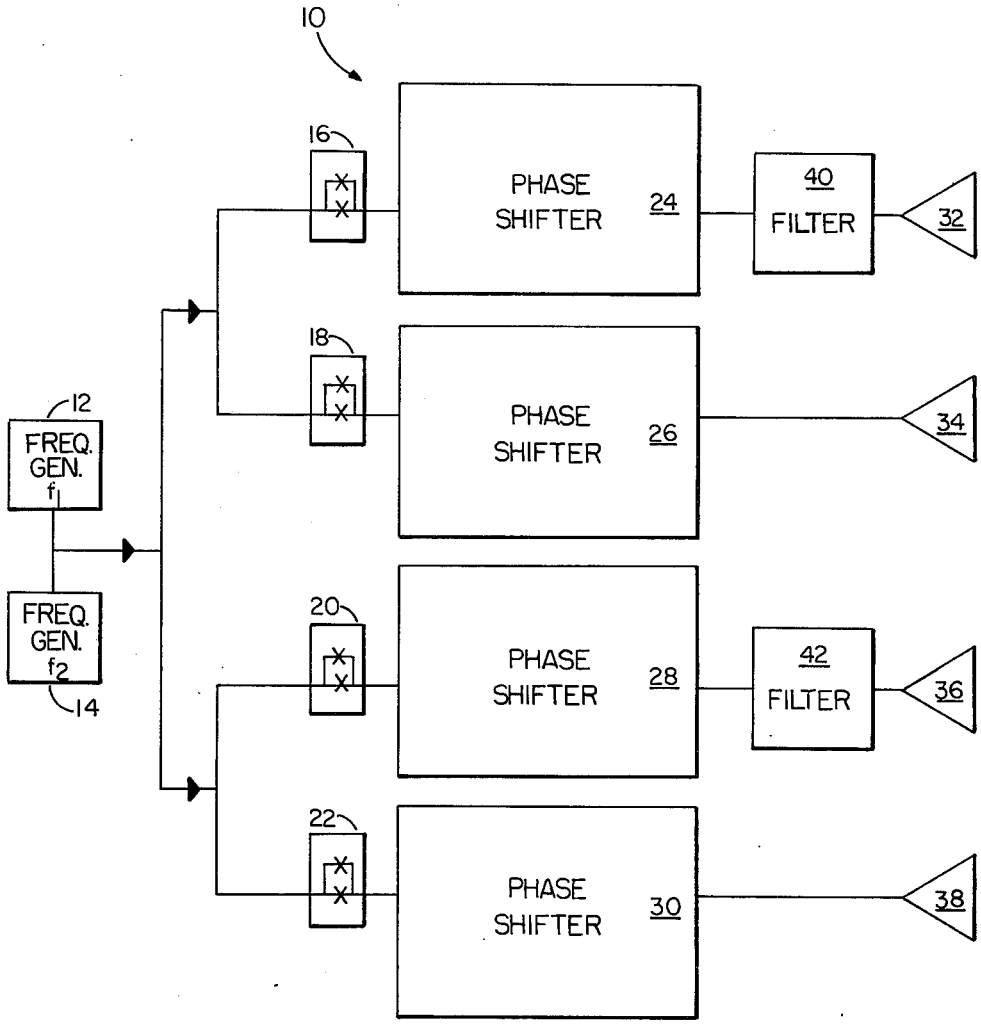
10
16
18
20
22
12
FREQ. GEN. f1
FREQ. GEN. f2
14
PHASE SHIFTER 24
PHASE SHIFTER 26
PHASE SHIFTER 28
PHASE SHIFTER 30
40 FILTER
42 FILTER
32
34
36
38

MULTIFREQUENCY ARRAY USING COMMON PHASORS

BACKGROUND OF THE INVENTION

The present invention relates generally to phased array antenna technology. Phased array antenna techniques show promise of providing high system reliability, high beam agility, flexible power control, beam shaping and stabilization, multiple-target capability and many other features. The application of these highly desirable antenna qualities is dependent upon low cost array components or multiple use of components. The adaptation of these antennas for fleet use has been awaiting development of technology that would provide complex, reliable and efficient circuits of relatively small size. This technology is developing rapidly, but still is not cost-effective.

Traditionally, the phased array antenna consists of many individual radiating elements which are excited through a corporate feed system to form a beam which is then steered in many planes by means of a phase shifter at each element. If $N_a$ is the number of elements in the azimuth plane, and $N_e$ is the number of elements in the elevation plane, then the total number, N, of phase shifters required is $$N = N_e N_a \quad (1),$$

and if a pencil beam is required then $N_a = N_e$ and $$N = N_e^2 \quad (2).$$

Since the phase shifter and its associated driver account for about one-half of the total array cost, it is evident that a reduction in the number of phase shifters is necessary for any significant cost reduction.

SUMMARY OF THE INVENTION

This invention relates to a method and apparatus for reducing the number of phase shifters required where multiple frequency operation is necessary or desirable and, more importantly, to a method and apparatus for permitting simultaneous dual or multiple beam capability in a single antenna array. This is accomplished by multiple frequency use of a single phase shifter and radiating element. In accordance with the present invention, use of a single phase shifter per element minimizes the number of phase shifters required by allowing at least two frequency bands to be used in a single antenna array to reduce the number of antennas required to perform several different functions and, thus also reducing the number of phase shifters required.

STATEMENT OF THE OBJECTS OF THE INVENTION

Accordingly, it is a primary object of the primary invention to disclose a novel method and apparatus for using a single phased array for several different functions.

Another object of the present invention is to disclose a novel method and apparatus for imparting simultaneous multiple beam capability in a single phased antenna array.

It is a further object of the present invention to disclose an apparatus and technique for making common use of antenna components where available space cannot support a distinct array for each distinct function as on a ship.

Other objects, advantages and novel features of the invention will become apparent from the following detailed description of the invention when considered in conjunction with the accompanying drawings.

BRIEF DESCRIPTION OF THE DRAWINGS

The sole FIGURE is a circuit schematic diagram of the multiple frequency array in accordance with the present invention.

DESCRIPTION OF THE PREFERRED EMBODIMENT

Referring now to the drawing there is illustrated the multi-frequency array 10 of the present invention. For purposes of simplicity only, the present invention is illustrated and described in terms of a dual-beam, four element array, although it is to be understood that the present invention is equally applicable to any array of any number of elements and that provision for more than dual-beam operation could also be incorporated.

For the dual-beam implementation illustrated and described herein, first and second frequency generators 12 and 14 are provided for generating the frequencies $f_1$ and $f_2$, respectively. The frequency signals generated by frequency generators 12 and 14 are distributed by a feed structure as is well known and are passed through the selector switches 16, 18, 20 and 22 to be described below. The outputs of the selector switches are furnished as inputs to the phase shifters 24, 26, 28 and 30. The phase shifters 24, 26, 28 and 30 may comprise, for example, switched line diode phase shifters. The outputs of the phase shifters feed the radiating elements 32, 34, 36 and 38. For the dual-frequency band approach, frequency filters 40 and 42 may also be provided intermediate phase shifter 24 and radiating element 32 and intermediate phase shifter 28 and radiating element 36. The frequency filters 40 and 42 are designed to block out the lower frequency signal, e.g., $f_1$, from alternate ones of the radiating elements in the antenna array.

There are several restrictions which must be placed on the array to insure that the basic array equations are satisfied for the frequency bands of interest. One requirement is that the operating frequencies selected are approximate multiples of each other, for example, $f_1 =$ 1.0GHz and $f_2 =$ 3.0GHz. Another requirement is that the array element spacings selected satisfy the equation for scanning at the highest operating frequency, i.e. for a single band linear array, $$\psi = (2\pi/\lambda)\, d_n \sin\theta \pm \delta \quad (3)$$

where $\psi$ is the total phase across the array and $2\pi/\lambda$ is the propagation constant. The phase increment, $\delta$, between elements is required to position the beam at an angle $\sigma$ known as the beam pointing angle and equal to the number of degrees off the broadside angle. The element spacing, $d_n$, is the physical spacing of the radiating elements at the highest operating frequency, $f_2$ in the present example. From equation (3) then it follows that for a dual frequency array, with the frequencies a multiple of each other, the following equations must be satisfied;

$$\left.\begin{aligned}\psi^{(1)} &= \frac{2\pi}{\lambda_1} d_{n1} \sin \theta_1 \pm \delta_1 \\ \psi^{(2)} &= \frac{2\pi}{\lambda_2} d_{n2} \sin \theta_2 \pm \delta_2\end{aligned}\right\} f_2 > f_1 \tag{4}$$

In order to suppress grating lobes, the maximum allowable element spacing is $0.59\lambda_2$ to scan the beam to $\pm 45°$ where $\lambda_2$ is the wavelength of the highest operating frequency. Thus, $$\left.\begin{aligned}\delta_2 &= k_2 d_2 \sin \theta_2 \\ \delta_1 &= k_1 d_1 \sin \theta_1\end{aligned}\right\}, k_i = \frac{2\pi}{\lambda_i}. \tag{5}$$

Now if for example, $f_2 = 3 f_1$, (5) becomes $$\left.\begin{aligned}\delta_2 &= k_2 d_2 \sin \theta_2 \\ \delta_1 &= (\tfrac{1}{3}) k_2 d_1 \sin \theta_1\end{aligned}\right\}, f_2 > f_1 \tag{6}$$

and if $d_1 = 2d_2$, then $$\left.\begin{aligned}\delta_2 &= k_2 \frac{d_1}{2} \sin \theta_2 \\ \delta_1 &= (\tfrac{1}{3}) k_2 d_1 \sin \theta_1\end{aligned}\right\} \tag{7}$$

Therefore:

$$\delta_1 = (\tfrac{2}{3}) \delta_2 \frac{\sin \theta_1}{\sin \theta_2}, f_2 > f_1 \tag{8}$$

The limitation that $d_1 = 2d_2$ imposed for the derivation of equation (7) above is derived by the inclusion of the frequency filters 40 and 42 as illustrated. These frequency filters are designed to block out the lower frequency signal $f_1$, according to the present example, from frequency generator 12 from alternate antenna elements so that the antenna spacings satisfy the operating requirements at all operating frequencies. Thus, by inclusion of the frequency filters 40 and 42, the lower frequency signal $f_1$ appears only at the radiating elements 34 and 38, whereas the higher frequency signal $f_2$ appears at each of the radiating elements 32, 34, 36 and 38. It is to be understood that, although discrete frequency filters 40 and 42 are illustrated, this feature could be incorporated in the radiating elements themselves as, for example, where the radiating elements are waveguide antenna elements which would inherently filter one frequency band and pass another.

Since the phase shifters 24, 26, 28 and 30 operate with linear function of frequency, they can each be used by two or more frequency bands which are multiples of each other. For each frequency band, however, it should be readily apparent that the same phase shifter will introduce a different phase shift, i.e., the phase shift introduced to the frequency signal $f_1$ will differ from the phase shift introduced to the frequency signal $f_2$ due to the fact that the frequency signals $f_1$ and $f_2$ are at different wavelengths and to the fact that the line lengths introduced by the phase shifters will accordingly appear to be different lengths to the different frequency signals. Where switched line diode phase shifters are used, for example, combinations of the various bits of phase shifters result in a phase increment, $\delta$which is applied to the radiating element. This phase increment $\delta$, is, of course, frequency dependent and, therefore, a fixed combination of bits in the phase shifter results in a distinct phase increment, $\delta$, for each frequency input. Thus, the frequency signal $f_1$ from frequency generator 12 results in a phase increment, $\epsilon_1$ for a predetermined combination setting of the phase shifter bits and, likewise, the frequency signal $f_2$ from frequency generator 14 results in a different phase increment $\delta_2$ for the same combination setting of the phase shifter bits. Thus, it can be seen that the same bits of the phase shifter are present for both frequency signals, but the phase shift introduced by these bits differs for each different frequency signal by a common factor which is dependent upon the ratio of the frequency signals. If desired, this factor can be changed by the addition of the selector switches 16, 18, 20 and 22 which, as seen in the drawing, are designed to selectively introduce an increased line length.

The multiple frequency band capability of the present invention will now be described for the two frequency case illustrated. The frequency generator 12 may generate a frequency signal $f_1$ in L band, for example, for IFF operation. The frequency generator 14 may generate a frequency signal $f_2$ in S band, for example, for search and tracking radar. It is to be understood, of course, that other frequency bands could be used. These frequency signals $f_1$ and $f_2$ are generated simultaneously and are propagated through the distribution network and through selector switches to the phase shifters 24, 26, 28 and 30. Each of the phase shifters will have a predetermined and different combination setting of phase shifter bits in order to establish the beam pointing angle $\theta$. The beam pointing angle $\theta$, is, as described above, frequency dependent and, therefore, will be different for each frequency signal $f_1$ and $f_2$. Each predetermined setting of the phase shifter bits will thus establish a distinct beam pointing angle for each frequency signal $f_1$ and $f_2$. By variation of the phase shifter bit combinations as is well known, beam steering will be achieved simultaneously for both of the beams generated.

It is thus apparent that by using several frequency bands in the same device, the number of antennas required prior to this invention to perform several different functions is reduced to a single antenna system.

Obviously many modifications and variations of the present invention are possible in the light of the above teachings. It is therefore to be understood that within the scope of the appended claims the invention may be practiced otherwise than as specifically described.

What is claimed is:

1. A phased array antenna system comprising:

first means including a plurality of frequency generators for simultaneously outputting a plurality of frequency signals, each said frequency signal being an approximate multiple of the one of said plurality of frequency signals having the lowest frequency;

a plurality of phase shifters connected to the output of said first means, each of said phase shifters being operably coupled to each of said frequency generators and each of said phase shifters introducing a different phase increment in response to each of said plurality of frequency signals;

a plurality of radiating elements each being operably coupled to one of said plurality of phase shifters;

whereby in response to each of said frequency signals, said plurality of radiating elements simultaneously generates a plurality of beams, each said beam having a different beam pointing angle.

2. The system of claim 1 wherein said radiating elements are spaced to permit scanning at the highest frequency of said plurality of frequency signals.

3. The system of claim 1 further including:

switch means connected between said first means and said plurality of phase shifters for selectively changing the phase increment introduced by each of said plurality of phase shifters.

4. The system of claim 1 wherein predetermined ones of said plurality of radiating elements have filter means operably coupled thereto for inhibiting the transmission thereto of predetermined ones of said plurality of frequency signals.

5. The system of claim 1 wherein said plurality of frequency signals comprises two frequency signals.

6. The system of claim 5 wherein alternate ones of said plurality of radiating elements have filter means operably coupled thereto for inhibiting the transmission thereto of said frequency signal having the lowest frequency.

7. A method of simultaneously generating at least two beams utilizing a single antenna array comprised of a plurality of radiating elements and a single phase shifter at the input to each said element comprising the steps of:

(1) simultaneously generating at least two frequency signals which are approximate multiples of the lowest frequency signal of said at least two frequency signals;

(2) simultaneously applying said at least two frequency signals to each said phase shifter at the input to each said element whereby each said phase shifter introduces a different phase shift in response to each said frequency signal and;

(3) applying the outputs of each of said phase shifters to its respective radiating element whereby said plurality of radiating elements form a separate beam for each said at least two frequency signals, each said beam having a different beam pointing angle.

8. The method of claim 7 wherein said step of applying the outputs of each of said phase shifters to its respective radiating element includes the step of filtering predetermined ones of said at least two frequency signals from predetermined ones of said plurality of radiating elements for the purpose of suppressing grating lobes.

9. The method of claim 8 wherein the step of generating at least two frequency signals comprises generating two frequency signals and wherein the step of filtering predetermined ones of said at least two frequency signals comprises filtering the lower frequency signal of said two frequency signals from alternate ones of said plurality of radiating elements.

10. The system of claim 1 wherein said phase shifters are diode phase shifter circuits.

* * * * *